US008681059B2

(12) United States Patent
Grossman et al.

(10) Patent No.: US 8,681,059 B2
(45) Date of Patent: Mar. 25, 2014

(54) ANTENNA CONFIGURATION

(75) Inventors: Ovadia Grossman, Tel Aviv-Yaffo (IL); Moshe Ben-Ayun, Shoham (IL); Maksim Berezin, Natanya (IL); Mark Rozental, Gedera (IL)

(73) Assignee: Motorola Solutions, Inc., Schaumburg, IL (US)

( * ) Notice: Subject to any disclaimer, the term of this patent is extended or adjusted under 35 U.S.C. 154(b) by 293 days.

(21) Appl. No.: 13/166,120

(22) Filed: Jun. 22, 2011

(65) Prior Publication Data

US 2012/0326938 A1 Dec. 27, 2012

(51) Int. Cl.
*H01Q 1/24* (2006.01)

(52) U.S. Cl.
USPC ..... 343/702; 343/790; 343/749

(58) Field of Classification Search
USPC ..... 343/702, 900, 901, 790, 749
See application file for complete search history.

(56) References Cited

U.S. PATENT DOCUMENTS

| | | | | |
|---|---|---|---|---|
| 5,898,406 | A * | 4/1999 | Matero | 343/702 |
| 6,404,396 | B1 * | 6/2002 | Hung et al. | 343/749 |
| 6,448,942 | B2 * | 9/2002 | Weinberger et al. | 343/895 |
| 2005/0088363 | A1 | 4/2005 | Grossman et al. | |
| 2010/0188303 | A1 | 7/2010 | Koh et al. | |

FOREIGN PATENT DOCUMENTS

| | | | |
|---|---|---|---|
| EP | 601576 | A1 | 6/1994 |
| EP | 1587159 | A1 | 11/2005 |
| GB | 2401248 | B | 3/2005 |
| GB | 2409108 | B | 7/2006 |
| GB | 2418781 | B | 11/2006 |
| JP | 2001144522 | A | 5/2001 |
| JP | 2000286625 | A | 10/2010 |

OTHER PUBLICATIONS

International Search Report for counterpart International Application No. PCT/US2012/041999 mailed on Oct. 19, 2012.

* cited by examiner

*Primary Examiner* — Dieu H Duong

(57) ABSTRACT

Antenna apparatuses and methods used in wireless communication devices are disclosed. The antenna includes a first portion configured to be coupled to a communication device. The antenna also includes a second portion configured to be coupled to the first portion. The first portion and second portion are coupled by overlapping the first portion and second portion so as to produce an omnidirectional radiation pattern and a vertical radiation pattern.

5 Claims, 3 Drawing Sheets

ANTENNA CONFIGURATION

FIELD OF THE DISCLOSURE

The present disclosure relates generally to configuration of an antenna and more particularly to providing an optimized antenna configuration with optimized radiation performance in both the horizontal plane and in the vertical direction.

BACKGROUND

An antenna is a specialized electronic device that converts energy from one form to another. An antenna couples radio waves in free space to electrical current used by electronic equipment, such as a portable radio, a mobile radio, and the like. In reception, the antenna intercepts some of the power of an electromagnetic wave in order to produce a voltage that a receiver of the coupled electronic equipment can amplify. During transmission, the electronic equipment produces radio frequency (RF) current that may be applied to terminals of the antenna in order to convert it into an electromagnetic wave (radio wave) radiated into free space.

Depending on the design of the antenna, radio waves can be sent toward and received from all horizontal directions ("omnidirectional"), typically with reduced performance in one or more directions, such as the sky or the ground. Alternatively, a directional or beam antenna may be designed to operate in a particular direction. There are notable physical differences in the design of antennas for different frequencies and purposes. Nevertheless, there are certain basic properties that define the function and operation of antennas. One of the properties most often of interest in the design of antennas is the radiation pattern. The radiation pattern of the antenna determines the spatial distribution of the radiated energy. For example, a vertical wire antenna gives uniform coverage in the horizontal (azimuth) plane, with some vertical directionality, and as such is often used for broadcasting purposes. As an alternative to a radiation pattern providing a uniform coverage, an antenna can have a directional radiation pattern.

In the field of wireless communication, there has been a recent trend to provide wireless communication devices that are operable in more than one frequency band. Examples of wireless communication devices include portable radios, mobile radios, mobile telephones, and the like. For example, these wireless communication devices may be designed to operate in 850/1900 Mega Hertz (MHz) bands, used, for example, in the Americas and/or the 900/1800 MHz bands used in other parts of the world. It will be appreciated that the configuration of an antenna suitably operable in a plurality of discrete frequency bands may impact the design of an associated wireless communication device.

In addition, the complexity of communications devices has increased such that communication devices typically serve multiple purposes. For example mobile telephones capable of operating on different frequency bands are likely to have built in satellite location functionality based on the Global Positioning System (GPS). As noted previously, the radiation pattern of omnidirectional antennas is typically reduced in certain directions such as the sky or the ground. Therefore, even though a wireless communication device with an omnidirectional antenna may include a GPS feature, because the vertical directionality of omnidirectional antennas is typically reduced in the direction of the sky or the ground, there remains room for optimization with respect to the GPS feature in wireless communication devices which incorporate omnidirectional antennas. It is well recognized by skilled artisans in the field of antenna design that it is very difficult to design a single antenna structure that is able to provide similar radiation performance in the horizontal plane and in the direction of the sky or the ground.

Accordingly, there is a need for an optimized antenna configuration suitable for a wireless communication device with optimized radiation performance in both the horizontal plane and in the direction of the sky.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
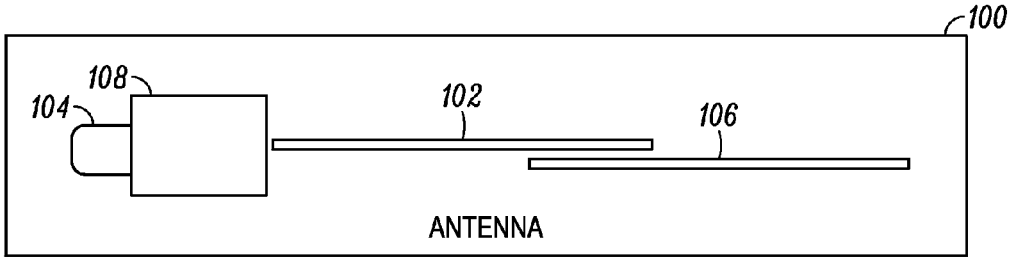
FIG. 1 is a diagram of an antenna in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Some embodiments are directed to antenna apparatuses and methods used in a wireless communication device. The antenna includes a first portion, wherein a first end of the first portion is configured to be coupled to a communication device. The antenna also includes a second portion, wherein a first end of the second portion is configured to be coupled to a second end of the first portion. The first portion and second portion are coupled by directly overlapping the first end of the second portion and the second end of the first portion or by overlapping another material over the first end of the second portion and the second end of the first portion so as to produce both an omnidirectional radiation pattern and a vertical radiation pattern.

Referring now to FIG. 1, an antenna 100 implemented in some embodiments is shown. Antenna 100 includes a first portion 102, which may be a monopole antenna, as the basis for the ultrahigh frequency (UHF) resonance. The first portion 102 may be referred to herein as a monopole antenna 102. First portion 102 includes a conducting base 108 which includes an end portion 104. In use, end portion 104 is attached conductively to a conducting member. In some embodiments, end portion 104 is threaded, allowing it to be attached mechanically and electrically to a conducting ground plane (not shown) of an associated communication device in a known manner. At the opposite side from end portion 104, monopole antenna 102 is attached/coupled to one end of a second portion 106 (also referred to as a Global Positioning System (GPS) antenna). The two portions 102 and 106 are galvanically disconnected, isolated one from the other and the main GPS radiation is concentrated in the upper portion of antenna 100.

Antenna 100 is configured to be attached to a communication device, such as a mobile radio, a portable radio, a mobile phone, and the like. In a communication link, a transmitter circuit of a first communication device may be connected through a coaxial cable, a micro strip transmission line or other such means to antenna 100. The signal to be transmitted is radiated in free space where it is "picked up" by another antenna of a second communication device. In the second communication device, the received signal is passed through another coaxial cable, a micro strip transmission line or other similar structure to a receiver circuit.

Figure 2:
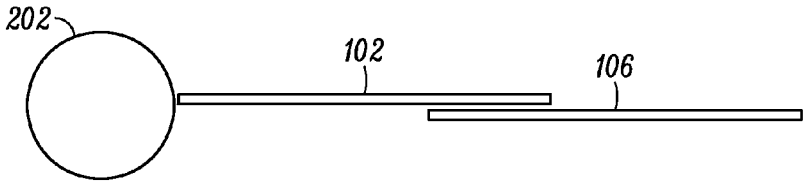
FIG. 2 is a diagram of a configuration of an antenna used in accordance with some embodiments.

FIG. 2 is a diagram of a configuration of an antenna used in accordance with some embodiments. A feed line 202 connects the monopole antenna 102 to a receiver circuit and/or transmitter circuit of an attached communication device. Feed line 202 transfers radio frequency (RF) energy from a transmitter circuit to monopole antenna 102, and/or from monopole antenna 102 to a receiver circuit, but does not radiate or intercept energy itself.

As is known to those skilled in the art, an antenna array is a configuration of individual radiating elements (in this case monopole antenna/first portion 102 and GPS antenna/second portion 106) that are arranged to produce a directional radiation pattern. The radiating pattern of the array depends on the configuration, the distance between the elements, the amplitude and phase excitation of the elements, and also the radiation pattern of individual elements. Because single-element antennas have radiation patterns that are broad and hence have a low directivity that is not suitable for long distance communications, in an embodiment, an end fire array effect is applied in the direction of the radiation element null. As is known in the art, an end-fire array is a linear or cylindrical antenna array that emits its radiation from one end. In the end-fire array arrangement, the maximum radiation is along the axis of the array. The end-fire array consists of a number of identical equally spaced antennas (in this case first portion 102 and second portion 106) arranged along a line and carrying current of equal amplitude. The first portion 102 and the second portion 106 in the end-fire array are so excited that there is a progressive phase difference between adjacent portions 102 and 106 expressed in wavelengths. In the embodiment shown in FIG. 2, the progressive phase difference between portions 102 and 106 in the end-fire array is a quarter wavelength. By arranging first portion 102 and second portion 106 in the end-fire array where the progressive phase difference between portions 102 and 106 is a quarter wavelength, the end fire array effect can be used to provide optimized upper hemisphere efficiency for GPS features implemented in communication devices, with efficiencies calculated at twice the current industry standard. Because of the configuration of the first portion 102 and the second portion 106, the antenna shown in FIG. 2 may be configured to operate in discrete frequency bands, for example 800/900 MHz frequency bands, and to provide for optimized GPS performance.

As is known to one skilled in the art, antennas detune (the frequency shifts) during use of the communication device to which the antenna is coupled. For example, when a radio to which an antenna is coupled is held in a hand or placed near a head, the antenna typically will detune. In an embodiment of antenna 100, if the capacitance or coupling is controlled/computed to achieve the required performance, there is no frequency shift or detuning. In particular, if the overlap capacitance is controlled/computed at four (4) times the original quarter wave antenna capacitance, the antenna will not be detuned when in user's hand.

Figure 3:
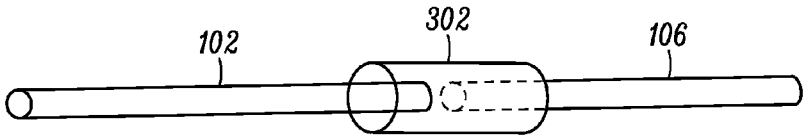
FIG. 3 is a diagram that shows a coupling technique used in some embodiments.

Different coupling techniques may be used for connecting the antenna 102 and 106. FIG. 3 is a diagram that shows a coupling technique used in some embodiments. In FIG. 3, rather than overlapping antenna 102 and antenna 106, as shown in FIG. 1 and FIG. 2, antenna 102 and antenna 106 are coupled by an overlapping conducting cylinder 302. In some embodiments, a metal crimp overlap antenna 102 and antenna 106 to control capacitance, and can achieve zero frequency shift when the communication device attached to the antenna is in a human hand. In an embodiment, each of antenna 102 and antenna 106 is constructed from a coaxial line. The coaxial line of antenna 102 and 106 includes a wire conductor surrounded by a tubular, braided metallic shield. The conductor is kept at the center of the shield by a dielectric, which is usually solid or foamed polyethylene. The shield is connected to a radio frequency (RF) ground, while the center conductor carries a RF signal. The shield, as its name implies, prevents the electromagnetic field inside the cable from escaping, and also prevents electromagnetic energy from entering the cable from outside. In this configuration, the end fed array of two coaxial dipoles cause the antenna to achieve up to sixty percent upper hemisphere efficiency. The upper hemisphere efficiency for current antennas, known in the art, is about seventeen percent.

Figure 4:
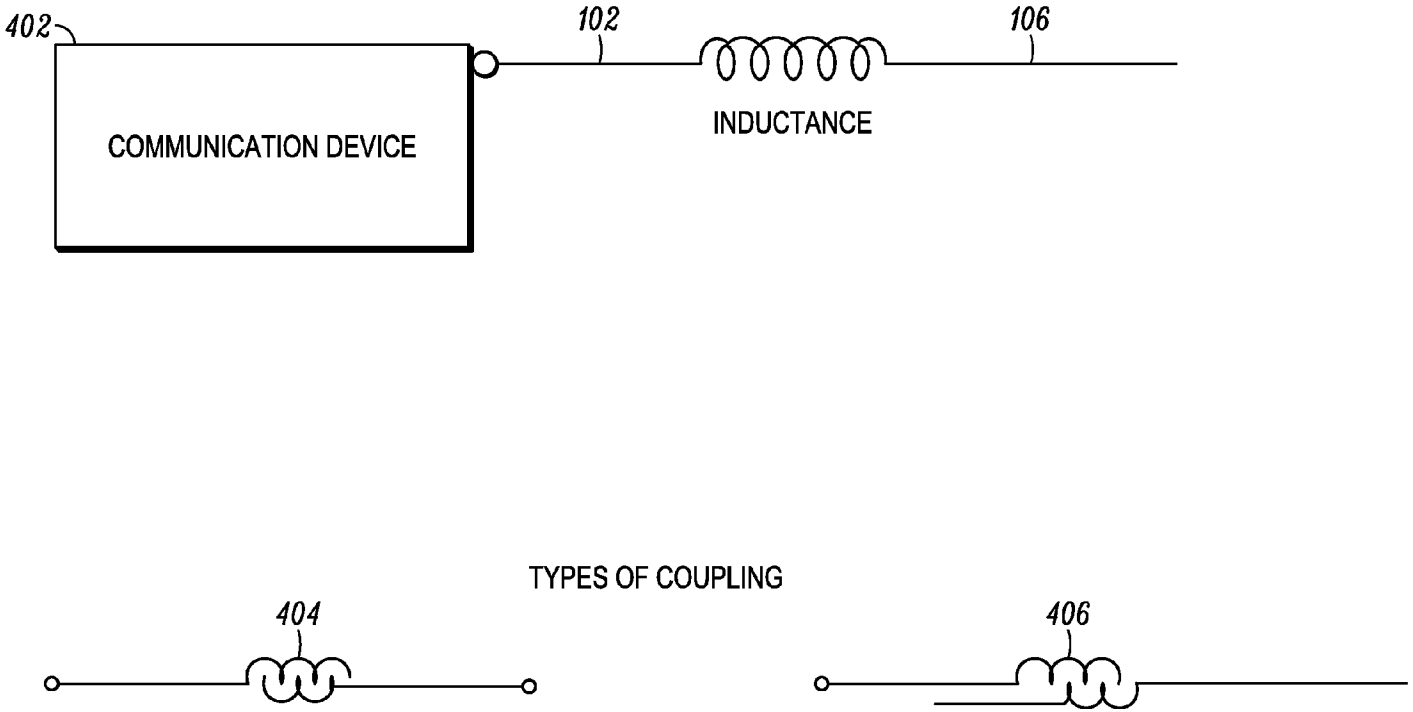
FIG. 4 is a diagram that shows another coupling technique used in some embodiments.

FIG. 4 is a diagram that shows another coupling technique used in some embodiments. In FIG. 4, antenna 102 and antenna 106 are coupled by overlapping close proximity coils. The coils of antennas 102 and 106 may be coupled in different ways, for example, as shown in 404 and 406. By centering inductance with the chassis of communication device 402, Ultra High Frequency (UHF) resonance is added to the antenna configuration of FIG. 4. The antenna configuration shown in this embodiment may operate in discrete frequency bands, for example UHF, 700/800/GPS bands. The actual size of antenna configuration depends on the dimension of the communication device 402 to which antenna configuration is attached.

The antenna configurations described above therefore provide for optimized GPS performance for communication devices. The antenna configurations described above also provide for improved in-hand performance. In some embodiments, the controlled upper load coupling improves in-hand performance by 3 db at the main frequency. The mechanical structure of the antenna described above is simplified, thus enabling production and cost reduction.

Figure 5:
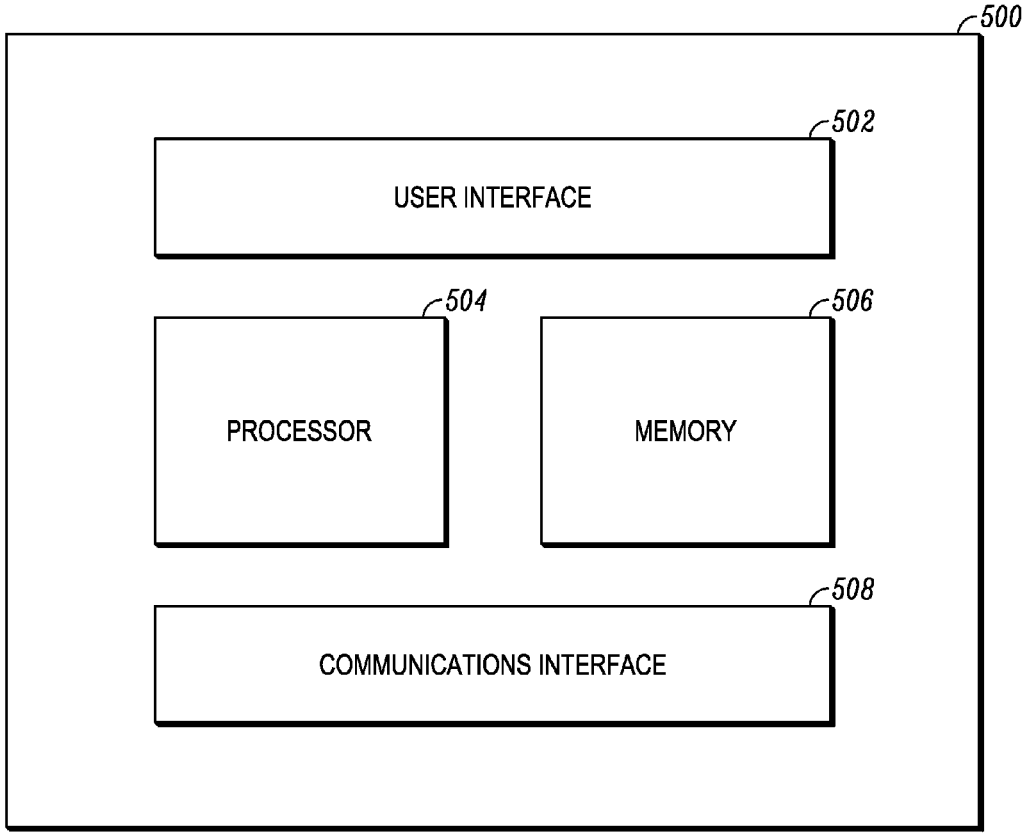
FIG. 5 is a block diagram which illustrates components of a typical wireless communication device to which an antenna is coupled in accordance with some embodiments.

FIG. 5 is a block diagram which illustrates components of a typical wireless communication device to which an antenna configuration used in accordance with some embodiments is coupled. According to an embodiment of the present invention the communication device 500 includes a user interface 502 such as a keypad, display or touch sensor; a processor 504 to control operating features of the radio; a memory 506 to store, for example, data and computer program code components; and a wireless networking communication interface 508, which enables the radio to communicate wirelessly with other radios. The wireless networking communication interface 508 is configured to incorporate one of the antenna configurations described herein. The user interface 502, memory 506 and communication interface 508 are each operatively connected to the processor 504. Those skilled in the art will appreciate that the memory 502 may include various types of memory such as a random access memory (e.g., static random access memory (SRAM)), read only memory (e.g., programmable read only memory (PROM)), electrically erasable programmable read only memory (EPROM), or hybrid memory (e.g., FLASH), as is well known in the art. The processor 504 accesses a computer useable medium in the memory 502, which medium includes computer readable program code components configured to cause the communication device to execute the functions described herein.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An antenna used in a wireless communication device, the antenna comprising:

a first portion, wherein a first end of the first portion is configured to be coupled to a communication device; and a second portion, wherein a first end of the second portion is configured to be coupled to a second end of the first portion, wherein the first portion and second portion carry current of equal amplitude and are coupled by overlapping close proximity coils of the second portion and first portion over the respective first end of the second portion and the second end of the first portion such that a progressive phase difference between the first portion and second portion is a quarted wavelength so as to produce both an omnidirectional radiation pattern and a vertical radiation pattern.

2. The antenna of claim 1, wherein in coupling the first portion and the second portion, the antenna is operable to be excited with the progression phase difference between the first and second portions to emit radiation in a direction of a radiation element null of the first portion and second portion.

3. The antenna configuration of claim 1, wherein the first portion is a monopole antenna.

4. A method for configuring an antenna used in a wireless communication device, comprising:

coupling a first end of a first portion of the antenna to a communication device; and coupling a first end of a second portion of the antenna to a second end of the first portion, wherein the first portion and second portion carry current of equal amplitude and are coupled by overlapping close proximity coils of the second portion and first portion over the respective first end of the second portion and the second end of the first portion such that a progressive phase difference between the first portion and second portion is a quarter wavelength so as to produce both an omnidirectional radiation pattern and a vertical radiation pattern.

5. The method of claim 4, further comprising exciting the antenna with the progression phase difference between the first and second portions to emit radiation in a direction of a radiation element null of the first portion and second portion when coupling the first portion and the second portion.

* * * * *

UNITED STATES PATENT AND TRADEMARK OFFICE

CERTIFICATE OF CORRECTION

PATENT NO. : 8,681,059 B2
APPLICATION NO. : 13/166120
DATED : March 25, 2014
INVENTOR(S) : Grossman et al.

It is certified that error appears in the above-identified patent and that said Letters Patent is hereby corrected as shown below:

In The Specification

In Column 5, Line 1, delete “memory 502” and insert -- memory 506 --, therefor.

In Column 5, Line 8, delete “memory 502,” and insert -- memory 506, --, therefor.

In The Claims

In Column 6, Line 54, in Claim 1, delete “quarted” and insert -- quarter --, therefor.

Signed and Sealed this
Tenth Day of May, 2016

Michelle K. Lee

Michelle K. Lee
*Director of the United States Patent and Trademark Office*